US011773697B2

(12) United States Patent
Li et al.

(10) Patent No.: US 11,773,697 B2
(45) Date of Patent: Oct. 3, 2023

(54) EXPANDABLE LINER AND METHOD FOR RUNNING THE SAME

(71) Applicant: GUANGZHOU INSTITUTE OF ENERGY CONVERSION, CHINESE ACADEMY OF SCIENCES, Guangzhou (CN)

(72) Inventors: Xiaosen Li, Guangzhou (CN); Fucheng Deng, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 336 days.

(21) Appl. No.: 17/276,495

(22) PCT Filed: Jan. 25, 2021

(86) PCT No.: PCT/CN2021/073556
§ 371 (c)(1),
(2) Date: Mar. 16, 2021

(87) PCT Pub. No.: WO2021/203799
PCT Pub. Date: Oct. 14, 2021

(65) Prior Publication Data

US 2022/0403716 A1 Dec. 22, 2022

(30) Foreign Application Priority Data

Dec. 28, 2020 (CN) ..... 202011578338.7

(51) Int. Cl.
*E21B 43/10* (2006.01)
*E21B 34/06* (2006.01)
*E21B 43/08* (2006.01)

(52) U.S. Cl.
CPC ..... *E21B 43/108* (2013.01); *E21B 34/06* (2013.01); *E21B 43/082* (2013.01); *E21B 2200/08* (2020.05)

(58) Field of Classification Search
CPC ..... E21B 43/103; E21B 43/086; E21B 34/06; E21B 2200/08; E21B 41/00; E21B 41/0092; E21B 41/0099; E21B 33/00
See application file for complete search history.

(56) References Cited

U.S. PATENT DOCUMENTS 2,981,333 A * 4/1961 Miller ..... F16L 55/24 166/228
4,416,331 A * 11/1983 Lilly ..... B01D 35/18 166/278

(Continued)

FOREIGN PATENT DOCUMENTS

CN 1601051 A 3/2005
CN 101250295 A 8/2008

(Continued)

*Primary Examiner* — George S Gray
(74) *Attorney, Agent, or Firm* — Bayramoglu Law Offices LLC

(57) ABSTRACT

An expandable liner and a method for running the same including a base pipe, wherein the base pipe is provided with a passage extending through an axial direction of the base pipe, a connection structure disposed at both ends of the base pipe, and screen openings on a wall of the base pipe; a porous expandable layer is fixedly attached to an exterior of the base pipe and made of a non-memory formed and compressible material. The expandable liner and the method, by adopting a non-memory porous expandable layer, realize a sand-control performance and a wellbore-supporting capability of a technology where memory materials are used in manufacturing, operating and running.

13 Claims, 6 Drawing Sheets

(56) References Cited

U.S. PATENT DOCUMENTS

| | | | | |
|---|---|---|---|---|
| 8,664,318 | B2 | 3/2014 | Guest et al. | |
| 2004/0261994 | A1* | 12/2004 | Nguyen | E21B 43/108 166/227 |
| 2015/0191983 | A1 | 7/2015 | Offenbacher et al. | |
| 2017/0074077 | A1 | 3/2017 | Bowen et al. | |

FOREIGN PATENT DOCUMENTS

| | | | | | |
|---|---|---|---|---|---|
| CN | 101379269 | A | | 3/2009 | |
| CN | 102604231 | A | | 7/2012 | |
| CN | 103384751 | A | | 11/2013 | |
| CN | 104177660 | A | | 12/2014 | |
| CN | 204121808 | U | * | 1/2015 | |
| CN | 105626002 | A | | 6/2016 | |
| CN | 108071374 | A | * | 5/2018 | E21B 43/086 |
| CN | 208364105 | U | | 1/2019 | |
| CN | 110295868 | A | * | 10/2019 | E21B 43/108 |

* cited by examiner

EXPANDABLE LINER AND METHOD FOR RUNNING THE SAME

CROSS REFERENCE TO THE RELATED APPLICATIONS

This application is the national stage entry of International Application No. PCT/CN2021/073556, filed on Jan. 25, 2021, which is based upon and claims priority to Chinese Patent Application No. 202011578338.7, filed on Dec. 28, 2020, the entire contents of which are incorporated herein by reference.

TECHNICAL FIELD

The present invention relates to the field of downhole liner tools for oil exploitation, and particularly relates to an expandable liner and a method for running the same.

BACKGROUND

Sand production is a phenomenon that commonly occurs during oil recovery. Mechanical methods are the most used sand-control technology, and sand-control liners play a key role in mechanical methods. In order to improve the sand-control effect, liners are generally used with gravel pack. Liners with gravel pack are known for their complex and time-consuming operation, heavy loading, high operating and manufacturing cost, and being prone to clogging, and thus it is of great technical and economic significance to develop sand-control devices with high sand-control effects and low cost. The Weatherford Company has developed an expandable liner whose outer wall can be pressed against the inner wall of a casing pipe or open hole after it is expanded, which reduces the space between the liner and the casing pipe and also reduce sand production. Currently the expandable liner technology has been developed but there are still disadvantages such as the untight contact between the outer wall of a liner and the inner wall of a casing pipe, small flow area, high manufacturing cost; thus, it is a key for current mechanical methods to develop more efficient and practicable expandable liners.

Patent literature CN105626002A mentions an expandable liner without the need for gravel packing, which comprises an expandable base pipe, a screen pipe surrounding the expandable base pipe, and an expandable matter surrounding the screen pipe, wherein the expandable matter comprises a shape memory polymer layer surrounding the screen pipe and a water-soluble polymer layer surrounding the shape memory polymer layer. However, this design has disadvantages such as difficulty to construct the expandable base pipe, and high costs especially for the shape memory polymer layer; moreover, the expandable matter can be easily damaged when the expandable liner bends at the well bottom, which may even results in failure of sand control.

Patent literature U.S. Pat. No. 8,664,318A1 mentions a shape memory structure. The shape memory structure comprises an elastic material and a viscoelastic material commingled with the elastic material, the shape memory structure being reformable from a first shape to a second shape upon exposure to a change in environment that softens the viscoelastic material thereby allowing the shape memory structure to creep under stress stored in the elastic material, and the shape memory structure being configured to maintain a filter material, not being one of the elastic material or the viscoelastic material, in a smaller volume when in the first shape than when in the second shape. This design also faces the problem that the shape memory structure may be easily damaged; moreover, oversize thickness of the viscoelastic material also affects the flow efficiency as the fluid flows through unnecessary filtering path, which increases energy consumption, and thereby also results in high costs.

SUMMARY

A first aspect of the present invention is to provide an expandable liner, which has significantly reduced manufacturing cost while its sand-control performance and wellbore-supporting capability are still guaranteed. The expandable liner comprises a base pipe, wherein the base pipe is provided with a passage extending through its axial direction, a connection structure disposed at its both ends, and screen openings on its wall; a porous expandable layer is fixedly attached to an exterior of the base pipe and made of a non-memory formed and compressible material.

As one improvement of the present invention, the non-memory formed and compressible material is hardened formed polyurethane, formed polyvinyl chloride, formed polyethylene, or formed polymethacrylimide.

As one improvement of the present invention, the porous expandable layer is adhesively attached to the base pipe via a degradable binder, which allows separating the base pipe from the porous expandable layer after operating for a period of time and thereby moving the base pipe out of the wellbore.

As one improvement of the present invention, a degradable constraining sleeve is provided at an exterior of the porous expandable layer, wherein the degradable constraining sleeve has an inner diameter smaller than a maximum outer diameter of the porous expandable layer when the porous expandable layer is not constrained. The degradable constraining sleeve constrains the porous expandable layer until it is decomposed downhole. After the degradable constraining sleeve is decomposed, the porous expandable layer will be attached to the wellbore more tightly.

As one improvement of the present invention, a water-soluble protective coating or/and a steel-mesh protective layer is provided at an exterior of the degradable constraining sleeve, wherein the steel-mesh protective layer is configured to protect the degradable constraining sleeve and change in diameter along with the porous expandable layer.

As one improvement of the present invention, a water-controlling valve is provided in the base pipe, wherein the water-controlling valve comprises a water-controlling valve outer ring, a water-controlling valve inner ring, and a water baffle; the water-controlling valve outer ring is fixedly attached to an inner wall of the base pipe, and the water-controlling valve inner ring is rotatably connected to the water-controlling valve outer ring; the water baffle is fixedly disposed in the water-controlling valve inner ring, and configured to partially block the water-controlling valve inner ring.

As one improvement of the present invention, the water baffle is provided with a weight at its lower part, wherein the weight is configured to maintain the water baffle at a lower position in the water-controlling valve under gravity; a guiding plate is provided at an upstream side of the water baffle, wherein an upper end of the guiding plate is connected to an upper end of the water baffle, and a lower end of the guiding plate is inclining along an upstream direction of the water-controlling valve.

As one improvement of the present invention, a water-controlling plate is provided in the base pipe, wherein the water-controlling plate comprises two water-controlling plate outer rings, two water-controlling plate inner rings, and a curved plate; the two water-controlling plate outer rings are spacedly disposed and fixedly attached to the inner wall of the base pipe, and the two water-controlling plate inner rings are rotatably connected to the two water-controlling plate outer rings respectively; both ends of the curved plate are connected to the two water-controlling plate inner rings respectively so as to allow the curved plate to cover a particular bottom area of the inner wall of the base pipe under gravity.

As one improvement of the present invention, the porous expandable layer is divided into an inner layer and an outer layer and an interface is formed therebetween, wherein the two layers on both sides of the interface are disconnected with each other, so as to allow the base pipe to be moved along the interface of the porous expandable layer after operating for a period of time.

A second aspect of the present invention is to provide a method for running the above-mentioned expandable liner, which allows conveniently running the expandable liner down to a horizontal well with simple operation, the method comprising:

S1: disposing the porous expandable layer on the exterior of the base pipe, wherein the porous expandable layer is configured to allow a fluid to pass radially through the porous expandable layer to enter the base pipe; the porous expandable layer can be compressed under an external force and expanded once the external force is removed;

S2: radially compressing the porous expandable layer, and enclosing the porous expandable layer in the degradable constraining sleeve, wherein the degradable constraining sleeve is configured to decompose after staying in a downhole environment for a period of time;

S3: moving the expandable liner downhole.

Compared with the prior art, the present invention has the following beneficial effects:

The expandable liner and its running method of the present invention, by adopting a non-memory porous expandable layer, realize the sand-control performance and wellbore-supporting capability of prior art technology where memory materials are used, which significantly reduces the costs in manufacturing, operating and running. In a preferable design, the liner is further featured by its water-controlling function, which can reduce the water content in crude oil when pumping oil.

REFERENCE SIGNS

Figure 1:
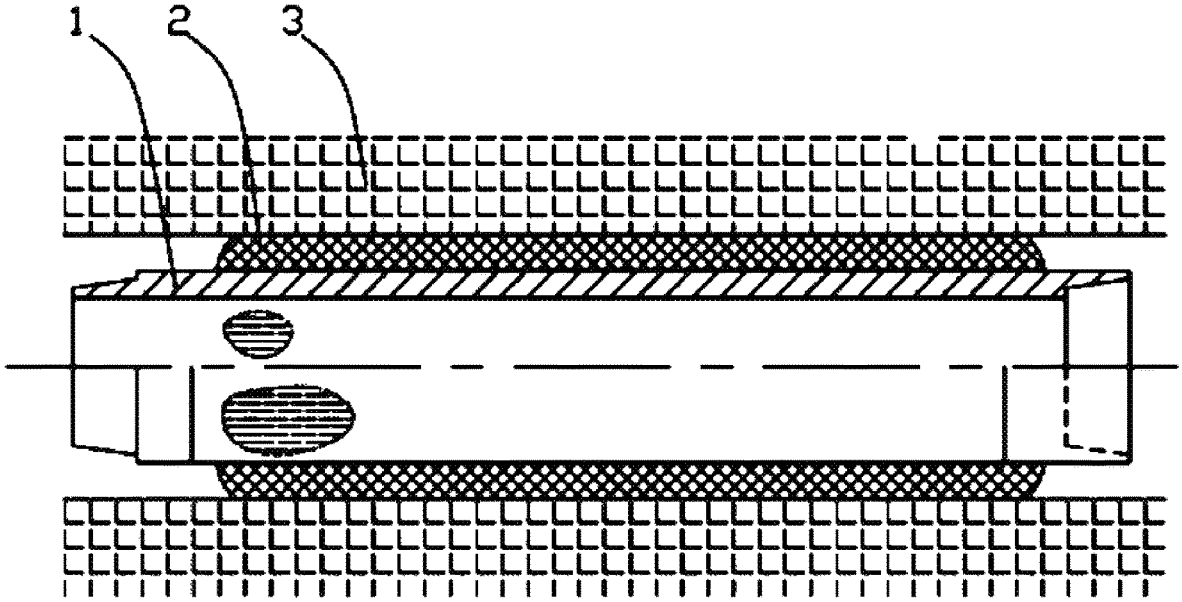
FIG. 1 shows one structure of the expandable liner of the present invention.

1—base pipe; 2—porous expandable layer; 3—wellbore; 4—securing collar; 5—flushing pipe; 6—water-controlling valve; 601—water-controlling valve outer ring; 602—water-controlling valve inner ring; 603—water baffle; 604—lip; 605—weight; 606—guiding plate; 7—water-controlling plate; 71—water-controlling plate outer ring; 72—water-controlling plate inner ring; 73—guiding ring; 74—curved plate; 8—compressing claw; 81—connecting beam; 82—push rod; 83—guiding rod; 84—claw body; 9—degradable constraining sleeve; 10—steel-mesh protective layer; 11—interface.

DETAILED DESCRIPTION OF THE EMBODIMENTS

The technical solutions of the present invention will be clearly and completely described below with the drawings in combination with the embodiments. It is obvious that, the embodiments described below are not all the embodiments of the present invention but only a portion thereof. Based on the embodiments described herein, all other embodiments proposed by those of ordinary skill in the art without creative work shall fall within the scope of the invention.

It should be understood that, any orientation or positional relationship indicated by the terms such as "center", "longitude", "transverse", "length", "width", "thickness", "upper", "lower", "front", "rear", "left", "right", "vertical", "horizontal", "top", "bottom", "inner", "outer", "clockwise", "counterclockwise", "axial", "radial", and "circumferential" is based on the orientation or positional relationship shown in the drawings, and is only for facilitating describing the invention and simplifying the description, but does not indicate or imply that the described device or element must have a specific orientation, or be constructed and operated in a specific orientation, and therefore cannot be understood as a limitation to the present invention.

Embodiment 1

Figure 2:
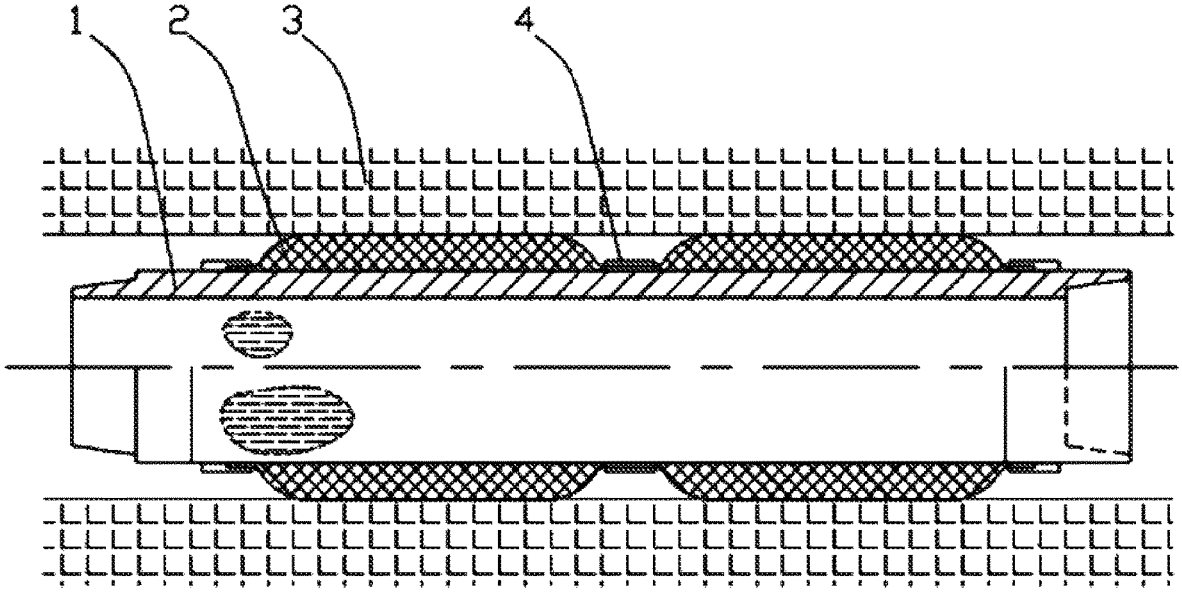
FIG. 2 shows another preferable structure of the expandable liner of the present invention.
Figure 3:
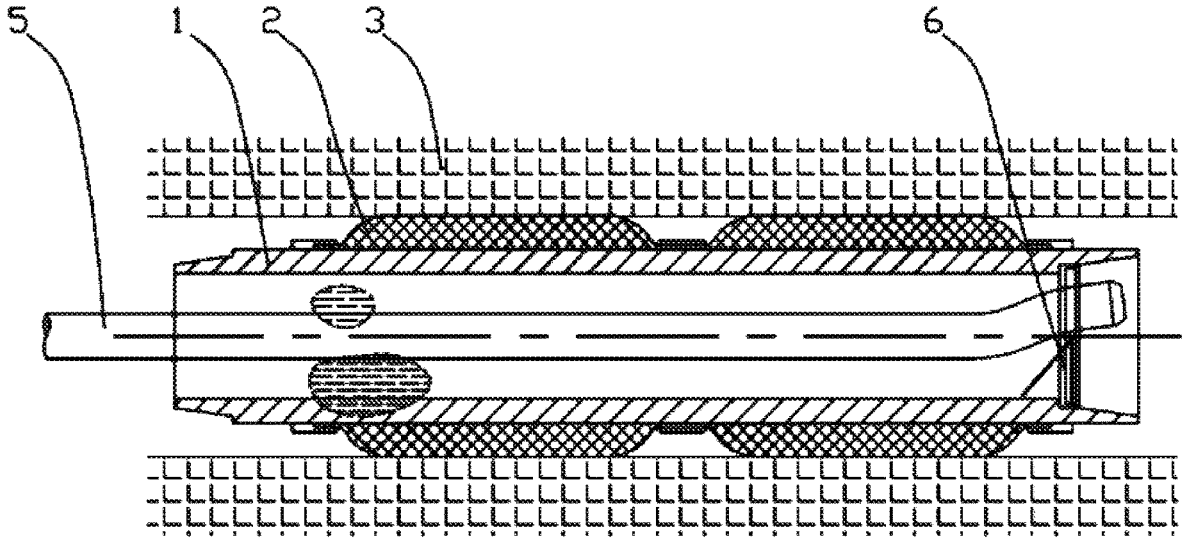
FIG. 3 shows one structure of the expandable liner with water-controlling function.
Figure 4:
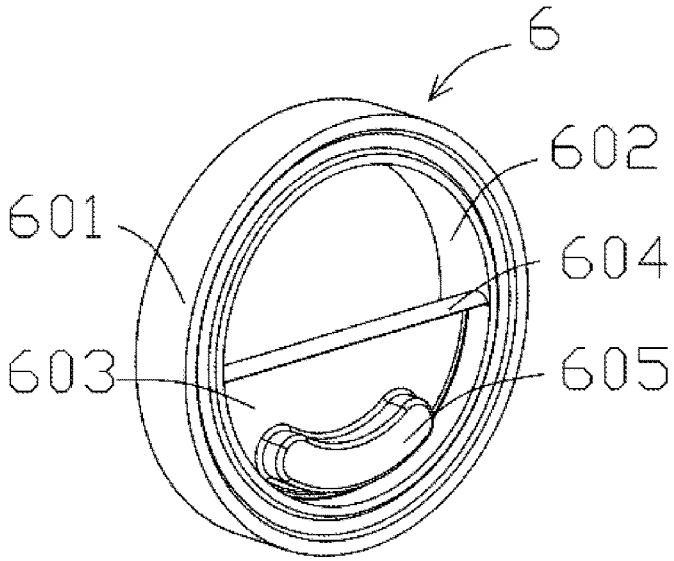
FIG. 4 shows a perspective view of the water-controlling valve in the present invention.

As shown in FIG. 1 and FIG. 2 is an expandable liner which comprises a base pipe 1. The base pipe 1 is provided with a passage extending through its axial direction, a connection structure for connecting to another liner is disposed at both ends of the base pipe 1, and screen openings are provided on the wall of the base pipe 1. Preferably, the screen openings are holes or slots. A porous expandable layer 2 is disposed on the base pipe 1, wherein the porous expandable layer 2 and the base pipe 1 are fixedly connected.

The fixed connection is realized by the porous expandable layer 2 being adhesively attached to the base pipe 1. Further preferably, the porous expandable layer 2 is adhesively attached to the base pipe 1 via a degradable binder. After the expandable liner has been used for 3 to 5 years, the binder decomposes and thereby the porous expandable layer 2 separates from the base pipe 1, which facilitates moving the base pipe 1 out; then well workover will be performed and a new porous expandable layer 2 will be provided to the base pipe 1 which will be then reused. Such design can significantly prolong the life of the base pipe 1 and thus reduce operating costs.

Another scheme for the fixed connection is as shown in FIG. 2, where the porous expandable layer 2 is attached to the base pipe 1 by using securing collars 4, and the securing collars are connected to the base pipe 1 via screws. This simple and convenient design can be applied when it is not necessary to move the base pipe 1 out.

The connection structure at both ends of the base pipe 1 may comprises a conical boss and a conical groove as shown in the drawings, which allow base pipes 1 of multiple expandable liners to be connected head-to-tail in series.

The porous expandable layer 2 is made of a non-memory formed and compressible material, such as hardened formed polyurethane, formed polyvinyl chloride, formed polyethylene, or formed polymethacrylimide. Accordingly, the present invention, as compared with the use of memory materials, has significantly reduced costs. The formed porous expandable layer 2 is perforated such that it allows a fluid to pass through. Preferably, the porous expandable layer 2 has a thickness not higher than 25 mm when in its natural state, so as to reduce resistance while the supporting performance can be guaranteed.

Embodiment 2

Figure 10:
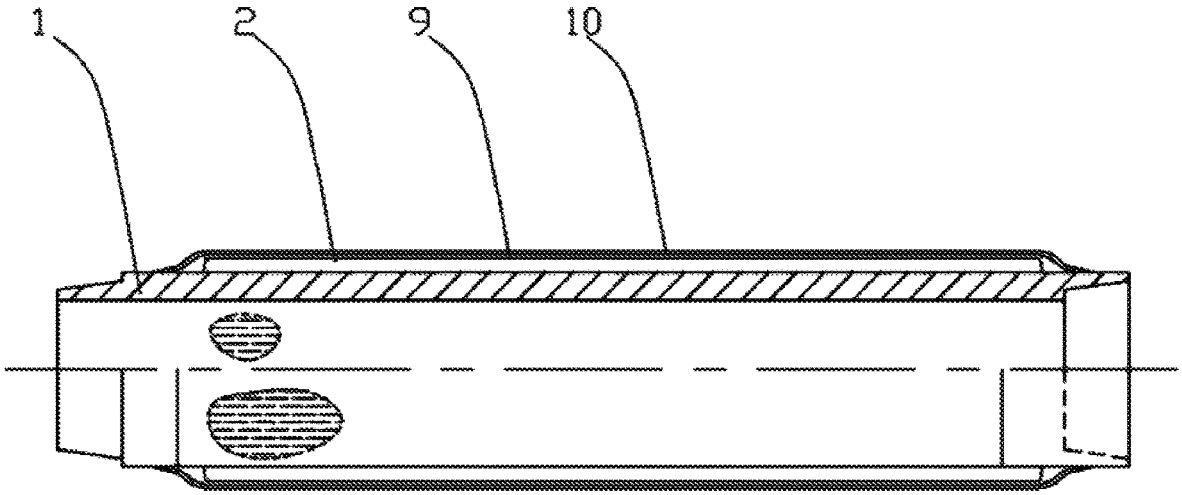
FIG. 10 shows the structure of the present invention when the porous expandable layer has been compressed.

As shown in FIG. 10, on the basis of Embodiment 1, a degradable constraining sleeve 9 is provided at an exterior of the porous expandable layer 2, wherein the degradable constraining sleeve 9 has an inner diameter smaller than a maximum outer diameter of the porous expandable layer 2 when the porous expandable layer 2 is not constrained. The degradable constraining sleeve 9 constrains the porous expandable layer 2 until it is decomposed downhole.

The degradable constraining sleeve 9 is made of prior art materials, such as a degradable plastic film as disclosed in CN101250295A, a degradable plastic composition as disclosed in CN104177660A, or a degradable plastic and a method for preparing the same as disclosed in CN102604231A. Sufficient constraining force can be guaranteed by adjusting the thickness of the degradable constraining sleeve 9.

The degradable constraining sleeve 9 is configured to completely decompose after staying in a 75° C. downhole environment for 3-10 days.

Embodiment 3

On the basis of Embodiment 2, a protective coating is provided at an exterior of the degradable constraining sleeve 9.

The protective coating may be a water-soluble coating configured to lower the decomposing rate of the degradable constraining sleeve 9 during storage and transportation. Preferably, the water-soluble coating is made of modified starch, which is mainly used to prevent the degradable constraining sleeve 9 from contacting water and thereby the degradable constraining sleeve 9 will hardly decompose, making it possible to precisely control the decomposing time downhole.

Embodiment 4

As shown in FIG. 10, on the basis of Embodiment 2, a steel-mesh protective layer 10 is provided at an exterior of the degradable constraining sleeve 9. The steel-mesh protective layer 10 is configured to protect the degradable constraining sleeve and change in diameter along with the porous expandable layer. In this embodiment, the steel-mesh protective layer 10 constitutes a mesh structure made of steel wires, and openings of the steel-mesh protective layer 10 are configured to have no blocking or filtering effect on the fluid. Also, the steel-mesh protective layer 10 does not constrain the porous expandable layer 2. When the expandable liner bends or enters a horizontal well, the steel-mesh protective layer 10 contacts with the wellbore wall and thereby protects the degradable constraining sleeve 9 from being damaged.

Embodiment 5

Figure 5:
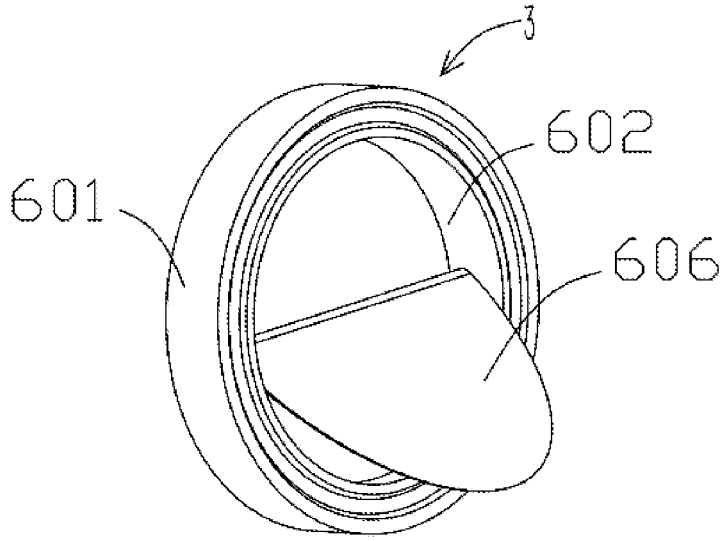
FIG. 5 shows another perspective view of the water-controlling valve in the present invention.

As shown in FIG. 5, on the basis of the above embodiments, a water-controlling valve 6 is further provided inside the base pipe 1. The water-controlling valve 6 comprises a water-controlling valve outer ring 601 and a water-controlling valve inner ring 602 which are rotatably connected. Preferably, between the water-controlling valve outer ring 601 and the water-controlling valve inner ring 602 is provided with ball bearings or plain bearings, and more preferably magnetic bearings. The water-controlling valve outer ring 601 is configured to be fixedly attached to an inner wall of the base pipe 1. A water baffle 603 is fixedly disposed in the water-controlling valve inner ring 602, and configured to partially block the water-controlling valve inner ring 602.

Preferably, a weight 605 is provided at a lower part of the water baffle 603, wherein the weight 605 is configured to maintain the water baffle 603 at a lower position in the water-controlling valve 6 under gravity.

Preferably, a guiding plate 606 is provided at an upstream side of the water baffle 603, wherein the guiding plate 606 is connected to an upper end of the water baffle 603 and inclining along an upstream direction of the water-controlling valve 6. A flushing pipe 5 can penetrate the water-controlling valve 6 along the guiding plate 606. For the flushing process, "upstream" herein refers to being closer to the wellhead, i.e. where the flushing pipe 5 comes into the wellbore. The guiding plate 606 constitutes a slope which facilitates the flushing pipe 5 pass through the water-controlling valve 6.

Some vertical wells may exhibit high water content, where water exists at lower level in the wellbore 3 of the vertical well while oil exists at higher level in the wellbore 3. The water baffle 603 is maintained at a lower position in the water-controlling valve 6 under gravity, such that the water flowing along the axial direction will be blocked while the oil is able to flow along each base pipe 1 to the wellhead. It has been evaluated that, during the oil pumping process, disposing three to five water-controlling valves 6 in the base pipes 1 close to the wellhead can reduce water content in crude oil by 5%-20%. The water-controlling valve 6 has a simple structure but is capable of largely improving oil exploitation efficiency.

Embodiment 6

Figure 6:
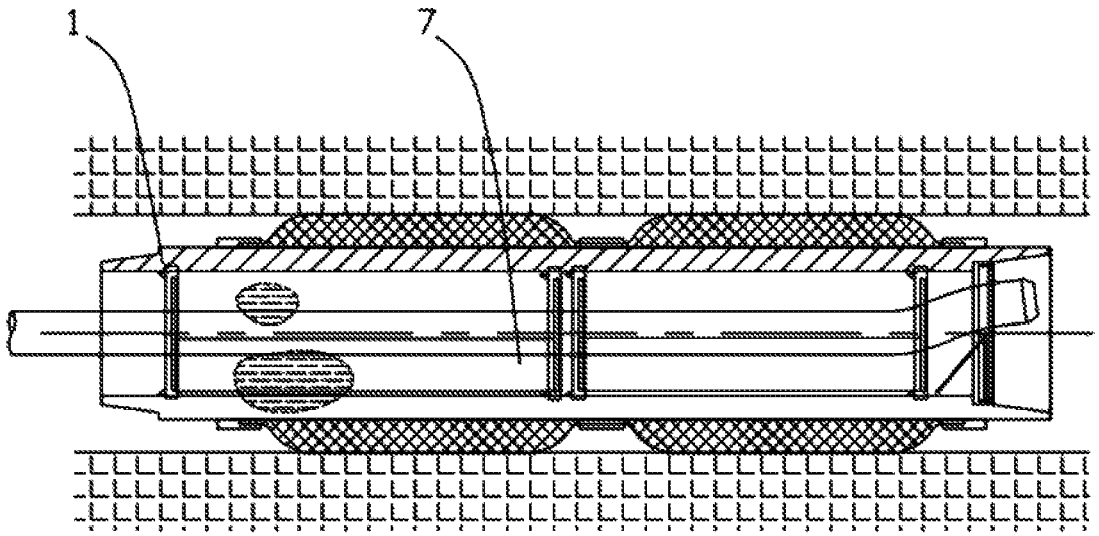
FIG. 6 shows one structure of the expandable liner with a water-controlling plate.
Figure 7:
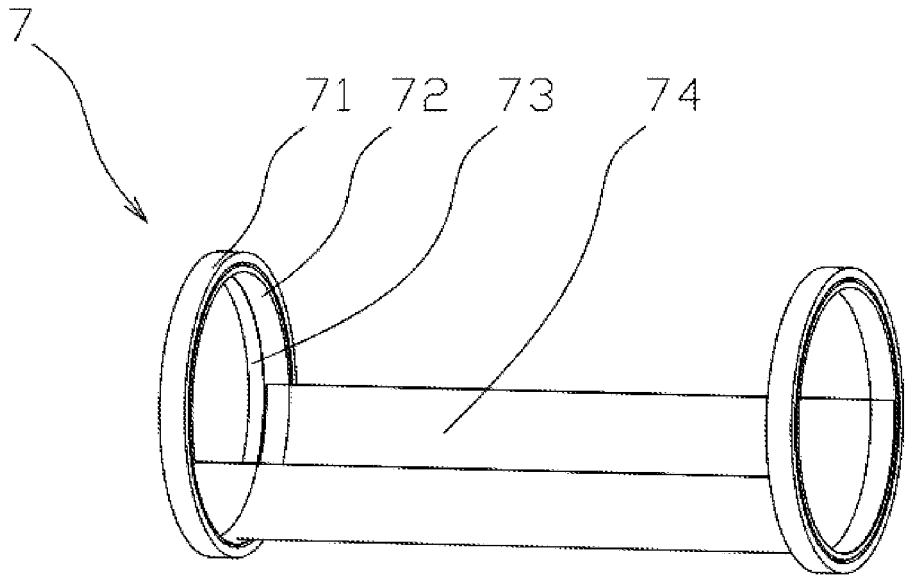
FIG. 7 shows a perspective view of the water-controlling plate in the present invention.

As shown in FIG. 6 and FIG. 7, on the basis of any one of the above Embodiments, a water-controlling plate 7 is provided in the base pipe 1. The water-controlling plate 7 comprises: two water-controlling plate outer rings 71 which are spacedly disposed and fixedly attached to the inner wall of the base pipe 1, two water-controlling plate inner rings 72 which are rotatably connected to the two water-controlling plate outer rings 71 respectively, and a curved plate 74 fixedly disposed between the two water-controlling plate inner rings 72. The curved plate 74 covers a particular bottom area of the inner wall of the base pipe 1 under gravity.

Such design is applicable for a wellbore 3 with higher water content. The curve plate 74 can largely prevent water from flowing into the base pipe 1 through the bottom, which significantly improves oil exploitation efficiency.

Preferably, in the base pipe 1 of every liner, multiple water-controlling plates 7 are provided. Preferably, the water-controlling plate outer rings 71 and the water-controlling plate inner rings 72 are connected via plain bearings. When the base pipe 1 is positioned in a horizontal well, the curved plate 74 will probably be at a lower position in the base pipe 1, such that the fluid intakes differ between the upper section and the lower section in the base pipe 1, wherein more fluid flows in through the upper section than the lower section, and thereby water control is realized.

The water-controlling valve 6 described in Embodiment 5 and the water-controlling plate 7 described in this Embodiment can be used individually or in combination, depending on actual situation.

Embodiment 7

Figure 11:
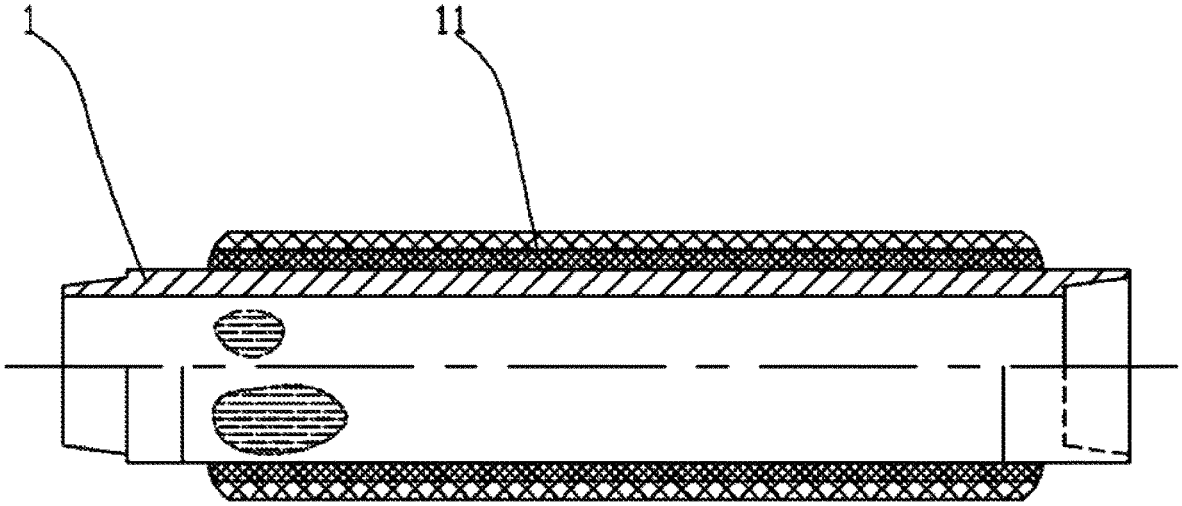
FIG. 11 shows another preferable structure of the expandable liner of the present invention.

As shown in FIG. 11, on the basis of Embodiments 1 to 6, an interface 11 was defined along the circumferential direction of the porous expandable layer 2. The interface 11 covers an area with an identical distance to the axis of the base pipe 1. The two layers on both sides of the interface 11 are disconnected with each other, so as to allow the base pipe 1 to be moved along the interface 11 of the porous expandable layer 2 after operating for a period of time.

Generally, after operating downhole for two year, it is difficult to move the expandable liner out since it has been secured in the wellbore 3 due to the pressure and sediment accumulation, which results in high operating costs. By providing such interface 11, the base pipe 1 and the porous expandable layer 2 can be separated at the interface 11, which facilitates moving the base pipe 1 out. After well workover is performed and the base pipe 1 is repaired, it will be then running downhole again, which significantly reduces operating costs.

Preferably, the outer porous expandable layer 2 is configured to have a pore size larger than that of the inner porous expandable layer 2. The inner porous expandable layer 2 is configured to have hardness higher than that of the outer porous expandable layer 2. When the liner is moving down, the degradable constraining sleeve 9 and the steel-mesh protective layer 10 help to fix the liner in position; when the liner is positioned in the wellbore, the base pipe 1 will not move. After the degradable constraining sleeve 9 and the steel-mesh protective layer 10 decompose or lapse, the base pipe 1 can be easily moved out for reuse. Such configuration also facilitates well workover.

Embodiment 8

A method for running the expandable liner described in Embodiments 1-7, comprises the following steps:

S1: This step comprises disposing the porous expandable layer 2 on the exterior of the base pipe 1. Preferably, the porous expandable layer 2 is made of a non-memory formed and compressible material, such as hardened formed polyurethane, formed polyvinyl chloride, formed polyethylene, or formed polymethacrylimide; the formed porous expandable layer 2 is perforated such that it allows a fluid to pass through; the porous expandable layer 2 is configured to allow the fluid to pass radially through the porous expandable layer 2 to enter the base pipe 1. The porous expandable layer 2 can be compressed under an external force and expanded once the external force is removed.

Figure 8:
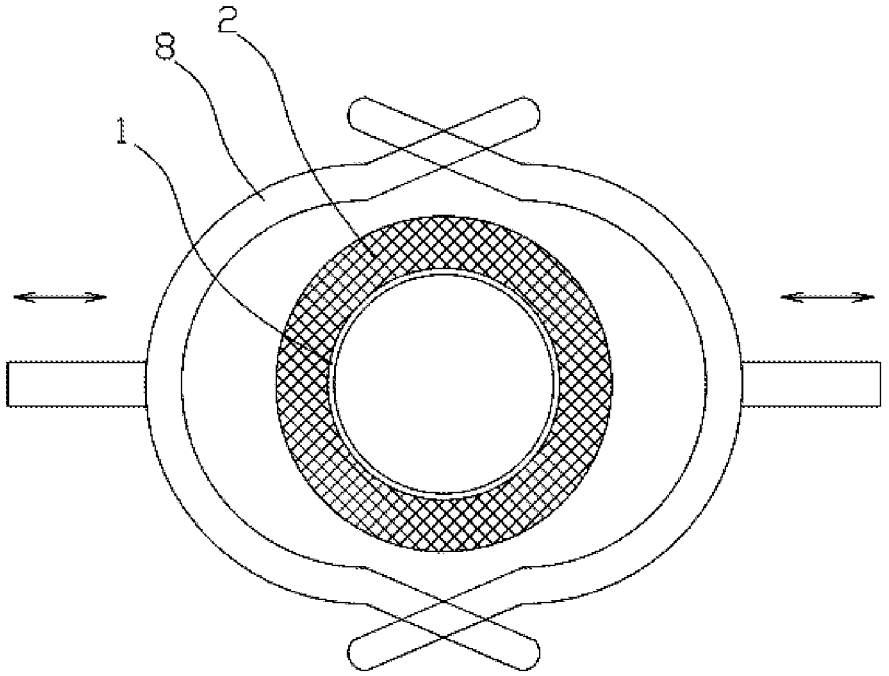
FIG. 8 shows a front elevational view of a device for compressing the porous expandable layer (2) in the present invention.
Figure 9:
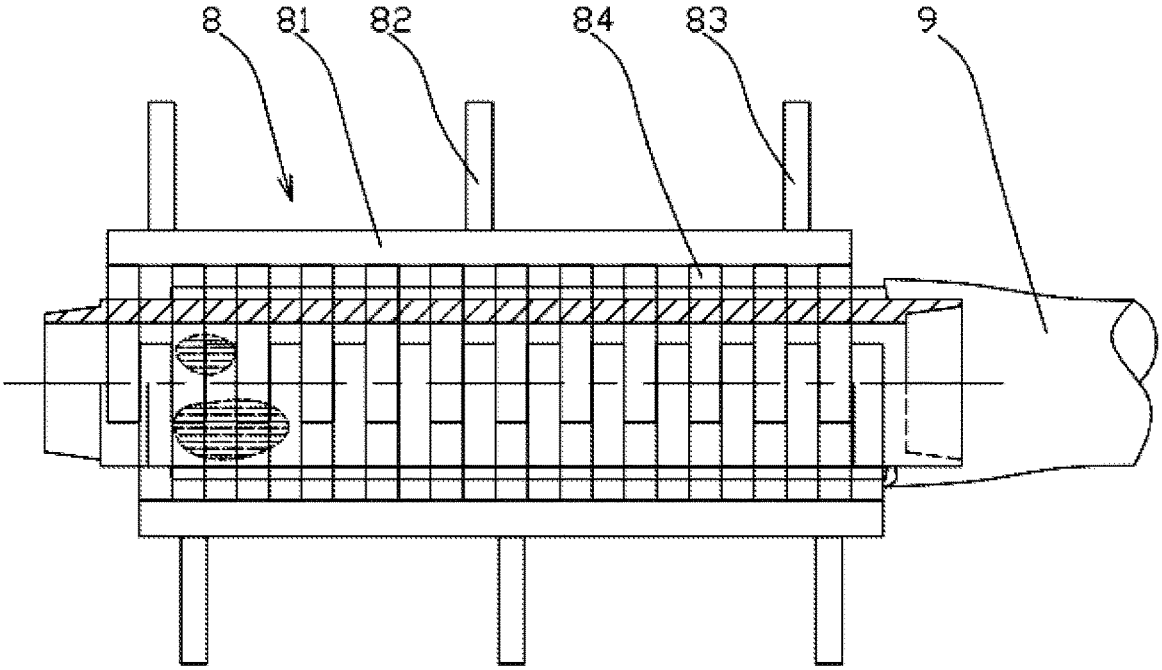
FIG. 9 shows a top plan view of the device for compressing the porous expandable layer (2) in the present invention.

S2: This step comprises radially compressing the porous expandable layer, preferably by the compressing claw 8 as shown in FIG. 8 and FIG. 9, and enclosing the porous expandable layer 2 in the degradable constraining sleeve 9. The degradable constraining sleeve 9 has an inner diameter smaller than an outer diameter of the porous expandable layer 2 when the porous expandable layer 2 is in its natural state.

S3: This step comprises moving the expandable liner downhole. Multiple expandable liners can be assembled before moved downhole by connecting their base pipes 1.

The degradable constraining sleeve 9 is configured to completely decompose after staying in a 75° C. downhole environment for 3-10 days. The porous expandable layer 2 will expand once it is not constrained.

The expandable liner is thereby moved downhole by the above steps.

After operating for a period of time, such as 5-8 years, the base pipe 1 should be moved out, for performing well workover, and removing the mud and sands accumulated in the wellbore 3 and remainder of the porous expandable layer 2. A new porous expandable layer 2 and a new degradable constraining sleeve 9 are disposed on the exterior of the base pipe 1 and thereby reuse of the base pipe 1 is realized.

Embodiment 9

On the basis of Embodiment 8, as shown in FIG. 8 and FIG. 9, the porous expandable layer 2 of the base pipe 1 is compressed by the compressing claws 8. The compressing claw 8 comprises staggered claw bodies 84. A cross section of each claw body 84 comprises a circular bottom structure, and the free side of the circular bottom structure is provided with a straight segment. At least two claw bodies are arranged opposite to each other, and their free sides are staggered. The free sides are articulated to a shaft. When the two claw bodies 84 come together, a complete circle is formed between them, and thereby the porous expandable layer 2 is compressed to a circular shape and subsequently enclosed in the degradable constraining sleeve 9.

Preferably, multiple claw bodies 84 are connected by a connecting beam 81. The connecting beam 81 comprises guiding rods 83 and push rods 82. The guiding rods 83 are configured to guide the compressing claw 8 sliding along the axial direction. The push rods 82 are connected to a reciprocating mechanism, such as an air cylinder, a lead screw mechanism or a pinion-rack mechanism.

The above embodiments are only for illustrating the technical concept and characteristics of the present invention, enabling those of ordinary skill in the art to understand the content of the present invention and implement accordingly, but not for limiting the scope of the present invention. All equivalent changes or modifications made according to the essence of the present invention should fall within the scope of the present invention.

What is claimed is:

1. An expandable liner, comprising a base pipe, wherein the base pipe is provided with a passage extending through an axial direction of the base pipe, a connection structure is disposed at both ends of the base pipe, and screen openings are formed on a wall of the base pipe, wherein a porous expandable layer is fixedly attached to an exterior of the base pipe, and the porous expandable layer is made of a non-memory formed and compressible material;

wherein a water-controlling valve is provided in the base pipe, wherein the water-controlling valve comprises a water-controlling valve outer ring, a water-controlling valve inner ring, and a water baffle; the water-controlling valve outer ring is fixedly attached to an inner wall of the base pipe, and the water-controlling valve inner ring is rotatably connected to the water-controlling valve outer ring; the water baffle is fixedly disposed in the water-controlling valve inner ring, and the water baffle is configured to partially block the water-controlling valve inner ring.

2. The expandable liner of claim 1, wherein the non-memory formed and compressible material is one selected from the group of hardened formed polyurethane, formed polyvinyl chloride, formed polyethylene, and formed polymethacrylimide.

3. The expandable liner of claim 1, wherein the porous expandable layer is adhesively attached to the base pipe via a degradable binder.

4. The expandable liner of claim 1, wherein a degradable constraining sleeve is provided at an exterior of the porous expandable layer, wherein the degradable constraining sleeve has an inner diameter smaller than a maximum outer diameter of the porous expandable layer when the porous expandable layer is not constrained; the degradable constraining sleeve is configured to constrain the porous expandable layer until the degradable constraining sleeve is decomposed downhole.

5. The expandable liner of claim 4, wherein a water-soluble protective coating or/and a steel-mesh protective layer is provided at an exterior of the degradable constraining sleeve, wherein the steel-mesh protective layer is configured to protect the degradable constraining sleeve and the steel-mesh protective layer is configured to change in diameter along with the porous expandable layer.

6. The expandable liner of claim 1, wherein a weight is provided at a lower part of the water baffle, wherein the weight is configured to maintain the water baffle at a lower position in the water-controlling valve under gravity;

a guiding plate is provided at an upstream side of the water baffle, wherein an upper end of the guiding plate is connected to an upper end of the water baffle, and a lower end of the guiding plate is inclining along an upstream direction of the water-controlling valve.

7. The expandable liner of claim 1, wherein a water-controlling plate is provided in the base pipe, wherein the water-controlling plate comprises two water-controlling plate outer rings, two water-controlling plate inner rings, and a curved plate; the two water-controlling plate outer rings are spacedly disposed and fixedly attached to the inner wall of the base pipe, and the two water-controlling plate inner rings are rotatably connected to the two water-controlling plate outer rings respectively; both ends of the curved plate are connected to the two water-controlling plate inner rings respectively wherein, the rotation of the plate inner rings in the plate outer rings allows the curved plate to swing to the bottom under the influence of gravity.

8. The expandable liner of claim 1, wherein the porous expandable layer is divided into two layers and an interface is formed between the two layers, wherein the two layers on both sides of the interface are disconnected with each other to allow the base pipe to be moved along the interface of the porous expandable layer after operating for a period of time.

9. A method for running the expandable liner of claim 1, comprising the following steps:

S1: disposing the porous expandable layer on the exterior of the base pipe, wherein the porous expandable layer is configured to allow a fluid to pass radially through the porous expandable layer to enter the base pipe; the porous expandable layer is compressed under an external force and expanded once the external force is removed;

S2: radially compressing the porous expandable layer, and enclosing the porous expandable layer in a degradable constraining sleeve, wherein the degradable constraining sleeve is configured to decompose after staying in a downhole environment for a period of time;

S3: moving an expandable liner downhole.

10. The method according to claim 9, wherein the non-memory formed and compressible material is one selected from the group of hardened formed polyurethane, formed polyvinyl chloride, formed polyethylene, and formed polymethacrylimide.

11. The method according to claim 9, wherein the porous expandable layer is adhesively attached to the base pipe via a degradable binder.

12. The method according to claim 9, wherein the degradable constraining sleeve is provided at an exterior of the porous expandable layer, wherein the degradable constraining sleeve has an inner diameter smaller than a maximum outer diameter of the porous expandable layer when the porous expandable layer is not constrained; the degradable constraining sleeve is configured to constrain the porous expandable layer until the degradable constraining sleeve is decomposed downhole.

13. An expandable liner, comprising a base pipe, wherein the base pipe is provided with a passage extending through an axial direction of the base pipe, a connection structure is disposed at both ends of the base pipe, and screen openings are formed on a wall of the base pipe, wherein a porous expandable layer is fixedly attached to an exterior of the base pipe, and the porous expandable layer is made of a non-memory formed and compressible material, wherein a water-controlling plate is provided in the base pipe, wherein the water-controlling plate comprises two water-controlling plate outer rings, two water-controlling plate inner rings, and a curved plate; the two water-controlling plate outer rings are spacedly disposed and fixedly attached to an inner wall of the base pipe, and the two water-controlling plate inner rings are rotatably connected to the two water-controlling plate outer rings respectively; both ends of the curved plate are connected to the two water-controlling plate inner rings respectively wherein, the rotation of the plate inner rings in the plate outer rings allows the curved plate to swing to the bottom under the influence of gravity.

* * * * *